US005121969A

United States Patent [19]

Schroeder

[11] Patent Number: 5,121,969

[45] Date of Patent: Jun. 16, 1992

[54] ADJUSTABLE HEAD REST FOR LOUNGES

[76] Inventor: Clifford A. Schroeder, Westlake Village, Calif. 91361

[21] Appl. No.: 673,058

[22] Filed: Mar. 21, 1991

[51] Int. Cl.[5] ..... A47C 7/38

[52] U.S. Cl. ..... 297/397; 297/410

[58] Field of Search ..... 297/391, 397, 438, 410

[56] References Cited

U.S. PATENT DOCUMENTS

| | | | |
|---|---|---|---|
| 3,114,527 | 12/1963 | Demarest | 297/397 |
| 3,129,975 | 4/1964 | Emery | 297/397 |
| 4,030,781 | 6/1977 | Howard | 297/397 |

*Primary Examiner*—Peter R. Brown
*Attorney, Agent, or Firm*—David O'Reilly

[57] ABSTRACT

An adjustable head rest for chaise lounges that allows a person to lie on their stomach without the necessity of turning their head. The head rest is constructed of a frame that fits between the slats of an existing chaise lounge and is adjustable by moving the portion beneath the slats in toward or away from the lounge. The extended end of the frame has a head support in the form of a strap attached across the frame. The head support is mounted on an angle portion of the frame that provides a comfortable position to rest the forehead. In a preferred embodiment of the invention the frame is in a U-shaped construction with the head support being slidable from an open end of the U-shape frame to the closed end to allow the adjustable head rest to be reversible for use with most types of chaise lounges. The U-shaped frame preferably has hinges and telescoping arms to allow the head rest to collapse to a small package for ease of transporting.

6 Claims, 4 Drawing Sheets

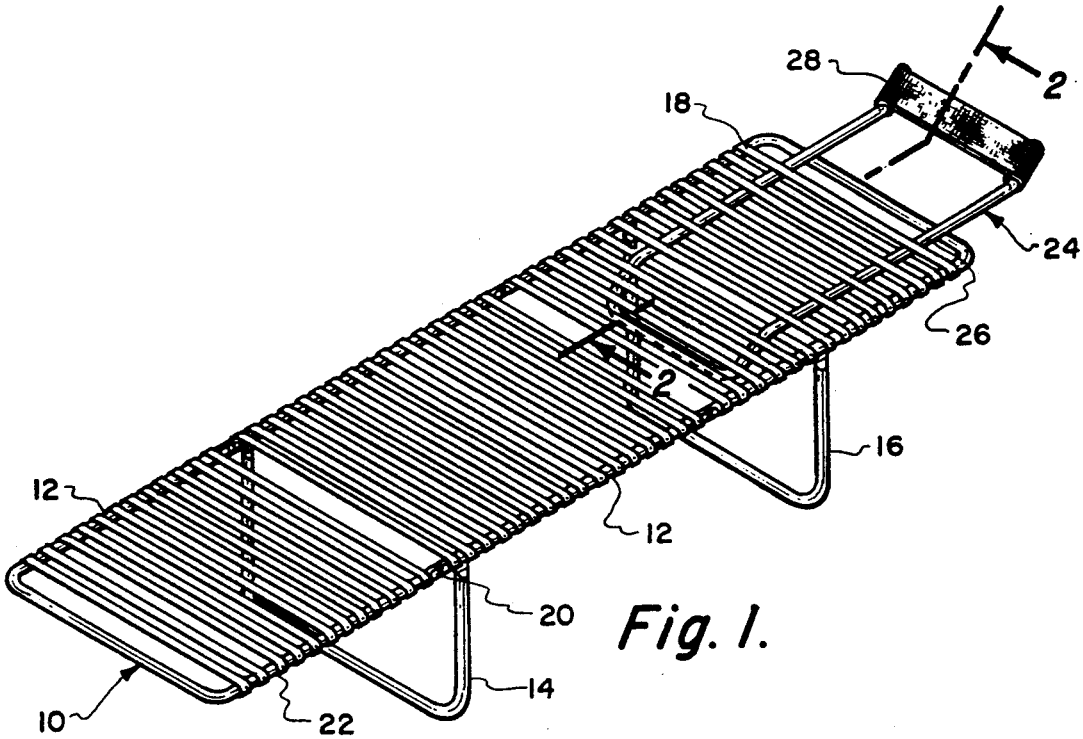
Fig. 1.
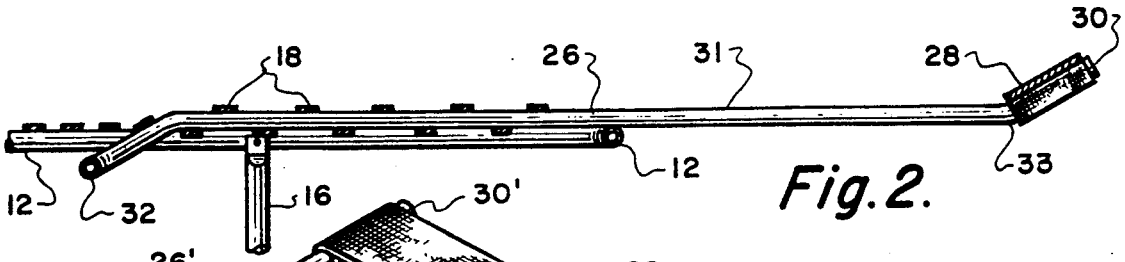
Fig. 2.
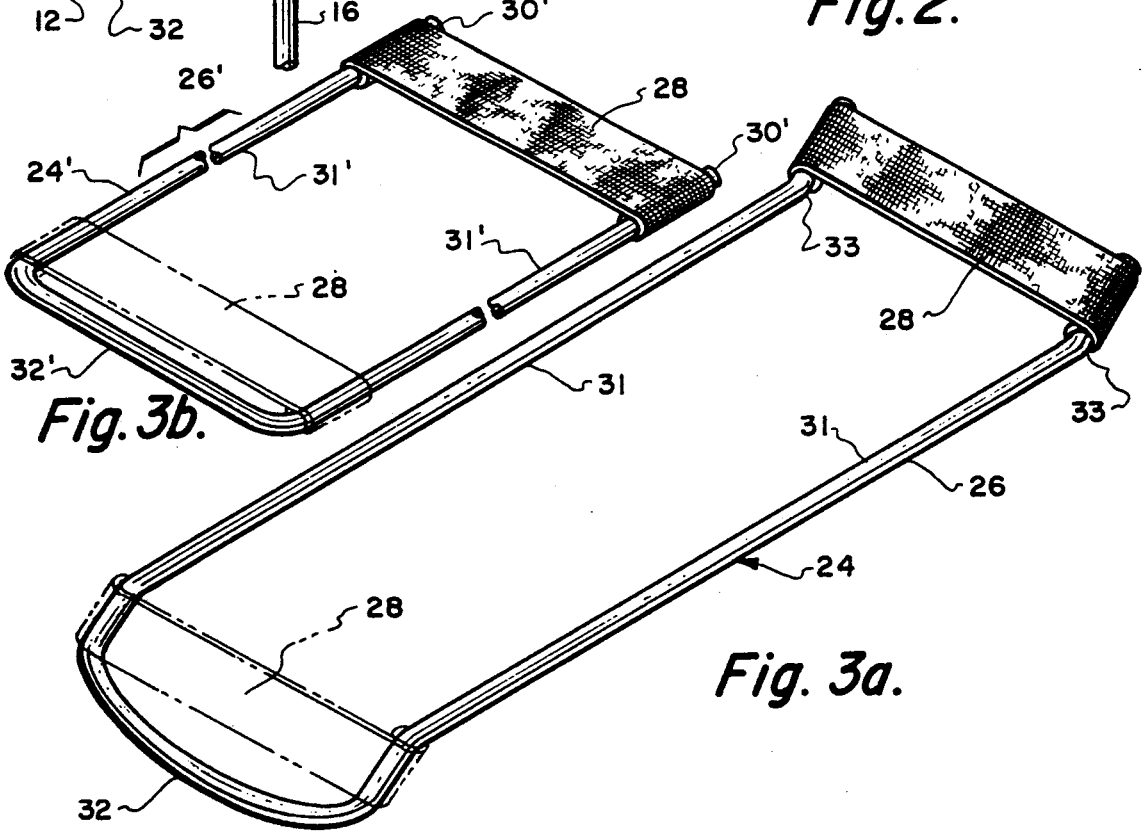
Fig. 3b.
Fig. 3a.

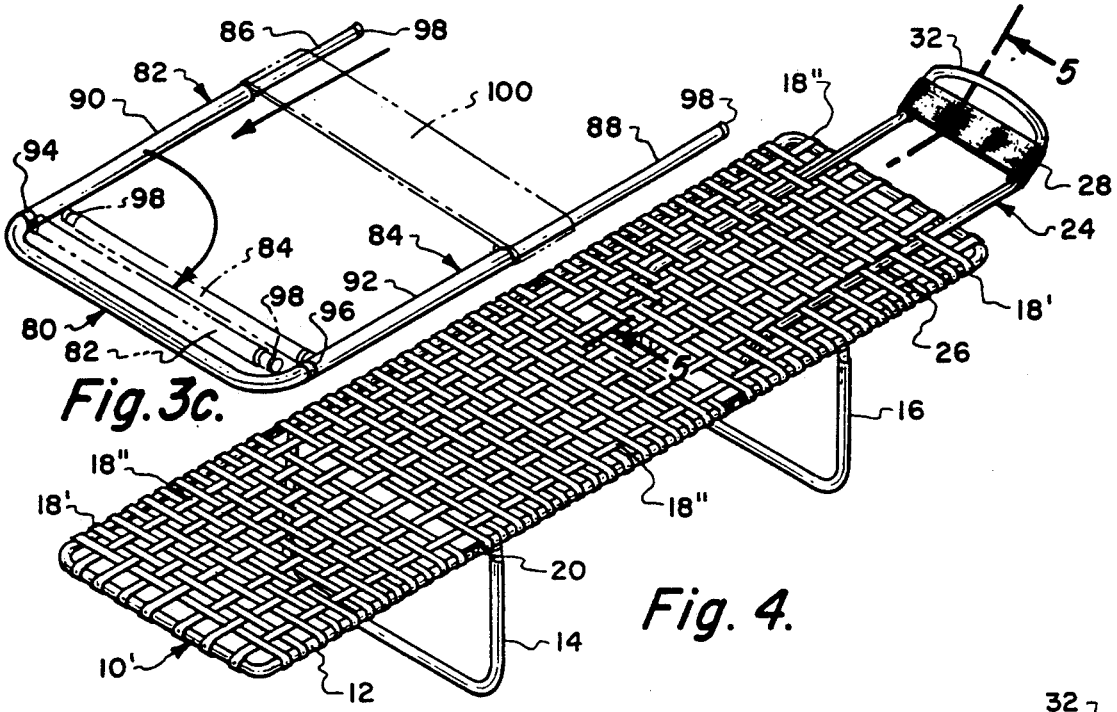
Fig. 3c.
Fig. 4.
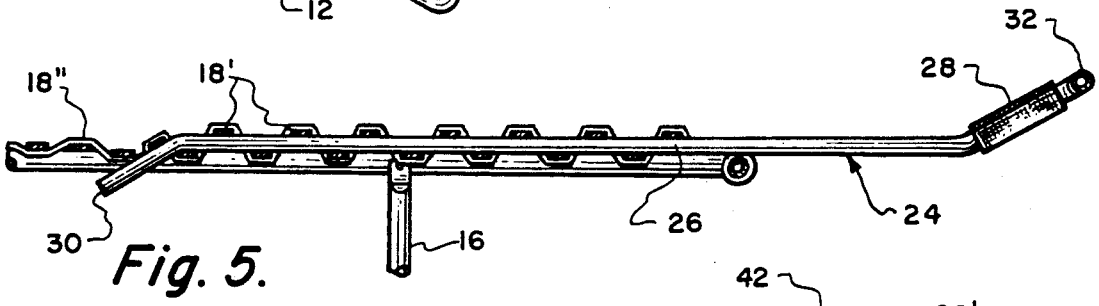
Fig. 5.
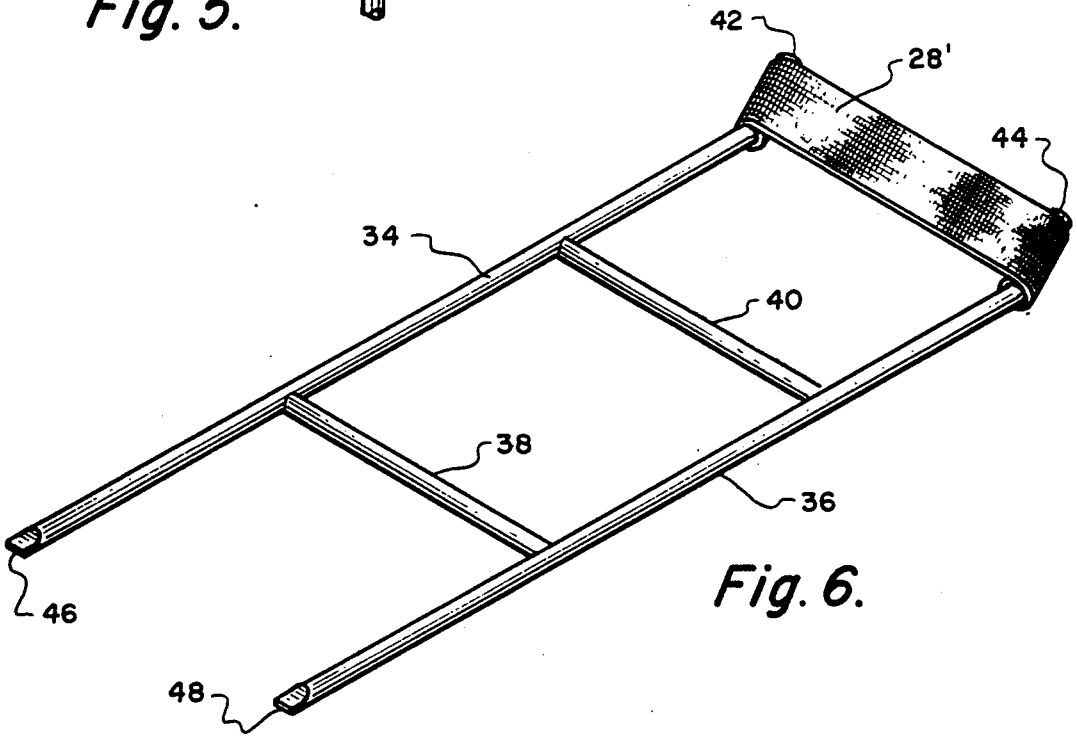
Fig. 6.

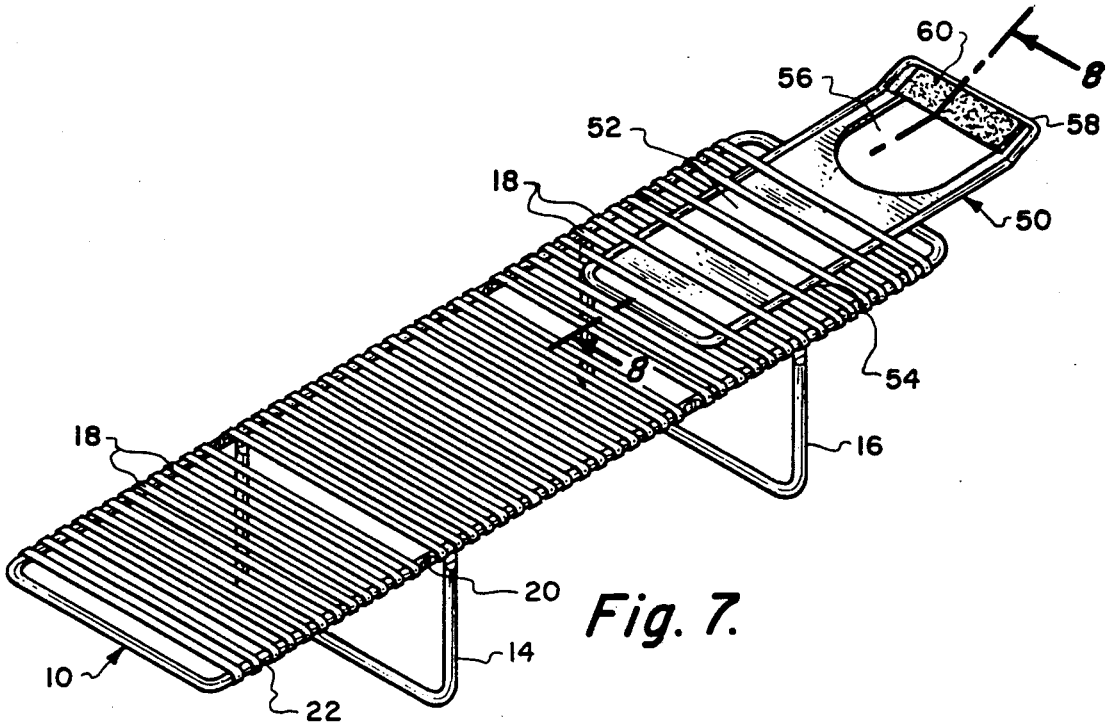
Fig. 7.
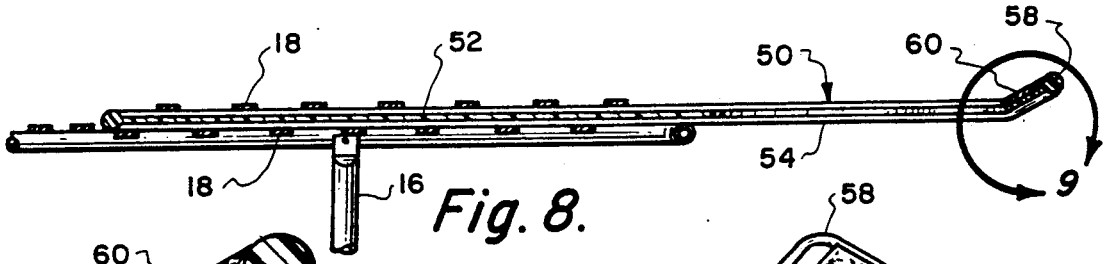
Fig. 8.
Fig. 9.
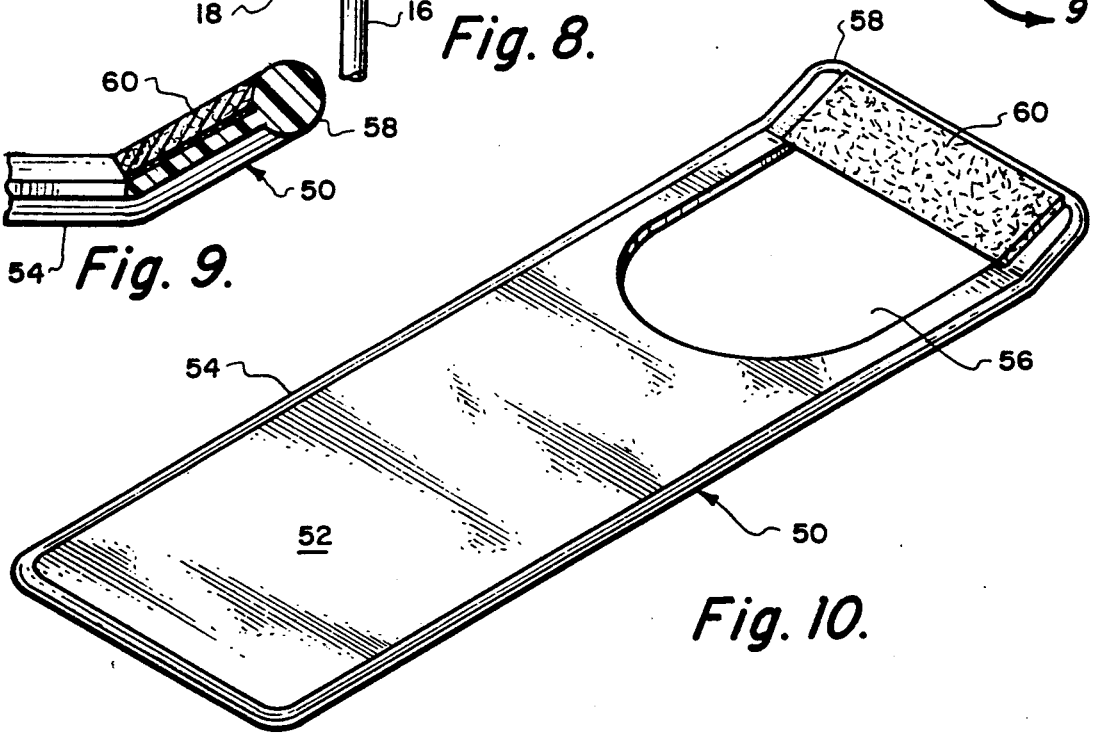
Fig. 10.

ADJUSTABLE HEAD REST FOR LOUNGES

FIELD OF THE INVENTION

This invention relates to head rests for sunbathing lounges and more particularly relates to an adjustable, reversible head rest for such lounges.

BACKGROUND OF THE INVENTION

Lounges for sunbathing known as chaise lounges are used pool side, on the beach or in any area where the activity of sunbathing is pursued. These lounges are usually constructed of a metal or wooden frame having straps or slats strung across the frame. The frame is mounted on legs and both the head and the foot ends are usually adjustable. They are adjustable to a variety of positions with the head or feet up or down or completely flat. They are usually light-weight in construction with the ends being foldable into a compact package for storage or transporting.

They are very convenient for sunbathing as the sunbather may lie in any position on the stomach or back with the head or lowered or the foot end raised or lowered. For people who prefer the pleasures of reading while lying on the lounge, they are unsuitable for lying on the stomach while reading. Further, people who have arthritic problems or stiff necks it presents a problem because the head must be turned to the one side or the other when lying on the stomach. Optionally a person can lie on the lounge with their head and shoulders extending over the end while holding reading material such as a book below. This is unsuitable as this position can only be maintained for very short periods of time.

It would be advantageous if some type of head rest could be provided to support the head and shoulders when lying on the stomach with the face downward.

It is therefore one object of the present invention to provide an adaptable head rest for existing chaise lounges.

Another object of the present invention is to provide a head rest for lounges that can be installed and adjusted quickly without the use of any tools. There are no screws, bolts, clamps or fasteners of any kind needed to install the head rest on almost all sunbathing lounges.

Yet another object of the present invention is to provide a head rest for chaise lounges that is extendible and adjustable.

Yet another object of the present invention is to provide a head rest for chaise lounges that is adaptable to most type of chaise lounge constructions.

Yet another object of the present invention is to provide an adjustable head rest for chaise lounges that is adaptable and reversible for use with chaise lounges having slats or a crossed matrix type construction.

BRIEF DESCRIPTION OF THE INVENTION

The purpose of the present invention is to provide an adjustable head rest for chaise lounges that is adaptable to all or to most types of chaise lounges and can be installed quickly without any tools.

This invention is in the form of a head rest comprised of a frame having a strap at one end for resting the head when lying in an anti-supine position with the face downward. The strap is constructed and arranged to support the forehead allowing a person to lie face downward on a lounge and provide complete support of the head. The frame of the head rest is formed in a U-shaped construction that allows the frame to slide under slats of a chaise lounge for support. No screws, bolts, clamps or fasteners of any kind are needed to quickly install and use the head rest. The length of the head rest extending beyond the end of the lounge is adjustable and it is completely portable. It can be taken from lounge to lounge with the user.

To install the head rest the frame portion opposite the head support is passed under and over alternating straps or slats of the chaise lounge. The weight of the body lying on the slats plus the engagement of the frame with the slats provides stable, steady support of the head when resting on the head strap on the opposite end of the frame. No tools are needed for installation. Just push it between the slots and it is ready to use.

In a preferred embodiment of the invention the frame is constructed to be reversible for use with chaise lounges that have a crossed strapped or matrix type construction. In this type of lounge frame the straps that provide support for the chaise lounge are in a matrix type construction with alternating straps running crosswise and lengthwise attached to the frame.

The alternate construction of the head rest frame allows the head support or strap to be slid from the open end of the U-shaped or curved frame to the closed end. The frame or head rest may now be reversed with the extending arms slid between adjacent lengthwise straps and under and over alternate crosswise straps to provide support for the head. The amount or length of the arms engaging the straps adjusts the length of the head rest extending beyond the end of the lounge. The head rest or strap is constructed of sturdy leather, vinyl, cloth or any other suitable, flexible material that is easily cleaned (such as terry cloth). The head support may be easily removed for cleaning or replacement with a new strap.

The above and other novel features and advantages of the invention will be more fully understood from the following detailed description and the accompanying drawings in which:

BRIEF DESCRIPTION OF THE DRAWINGS

FIG. 1 is a perspective view of a chaise lounge having an adjustable head rest constructed according to the invention.

FIG. 2 is a sectional view taken at 2—2 of FIG. 1.

FIG. 3*a* is a perspective view of the preferred embodiment of the adjustable and reversible head rest according to the invention.

FIG. 3*b* is a perspective view of an alternate embodiment of the adjustable and reversible head rest with the ends flat.

FIG. 3*c* is an alternate embodiment similar to FIG. 3*b* in which the U-shaped head rest has telescoping and folding arms.

FIG. 4 illustrates another embodiment of the adjustable head rest for use with cross-slatted or matrix type chaise lounges FIG. 5 is a sectional view taken at 5—5 of FIG. 4.

FIG. 6 is a perspective view of the adjustable head rest illustrated in FIG. 4.

FIG. 7 is a perspective view of another alternate embodiment of the invention.

FIG. 8 is a sectional view taken at 8—8 of FIG. 7.

FIG. 9 is partial sectional view illustrating the head rest portion of the embodiment of FIG. 7 taken at 9 of FIG. 8.

FIG. 10 is a perspective view of the alternate embodiment of FIG. 7.

DETAILED DESCRIPTION OF THE INVENTION

Figure 11:
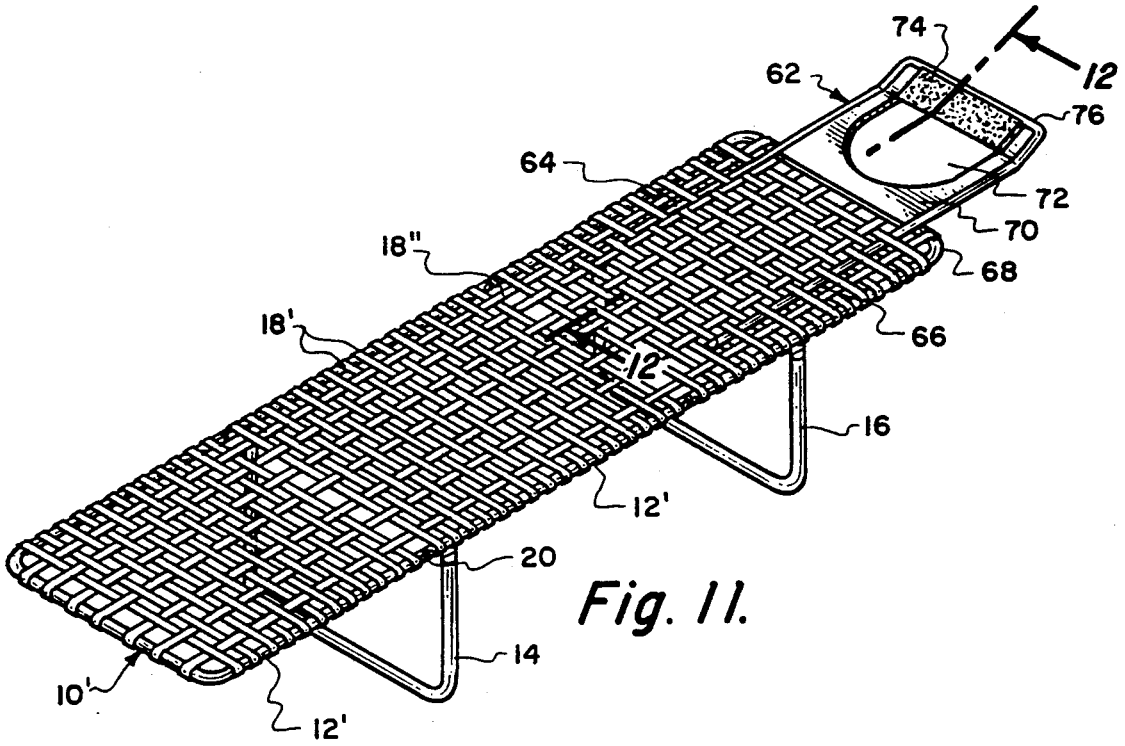
FIG. 11 is a perspective view of a chaise lounge with another alternate embodiment of the invention.

The preferred embodiment of an adjustable head rest for use with chaise lounges is illustrated in FIGS. 1 through 3. Chaise lounge 10 shown in FIG. 1 is comprised of a rectangular frame 12 supported by legs 14 and 16. The bed or surface of the lounge 10 is constructed by a plurality of straps or slats 18 stretched across frame 12 and attached on either side. The lounge 10 is hinged at 20 to allow the position of head portion to be adjusted up or down. This allows the head end 22 of the lounge 10 to be adjusted from an upright position similar to a chair to a completely flat position as shown so that a sunbather may lie on their back in a supine position or on their stomach. A similar adjustable hinge (not shown) is usually provided at the foot end.

However, when lying on their stomach it is sometimes uncomfortable if the person has any kind of arthritic or stiffness of the neck. It is certainly inconvenient if the person is trying to read while lying on their stomach. For this reason it would be advantageous if some type of head rest can be provided so that a person could lie on their stomach in a comfortable position with their face downward.

For this purpose an adjustable head rest 24 has been designed as shown in FIGS. 3*a* and 3*b*. This adjustable head rest is comprised of a frame 26 constructed in a U-shape having closed end 32 and a head support 28 attached at ends 30 of arms 31 that preferably, are slightly angled at 15 to 45 degrees at 33 to the plane of the adjustable head rest as shown in FIG. 3*a* to support the head in a nearly horizontal position. The head is supported by resting the forehead on support 28. An alternate but less desirable construction would be to make the ends 30′ of arms 31′ and closed end 32′ flat as shown in FIG. 3*b*.

Strap or head support 28 may be constructed of any suitable material that provides sufficient support while being soft enough not to apply too much pressure to the forehead. Suitable material for strap 28, would be terry cloth, leather, vinyl, or any other soft material that is strong enough to support the head while avoiding deterioration from exposure to the elements. It is quickly and easily removed by sliding over the ends 30 of frame 26 for cleaning or replacement.

Frame 26 is constructed of aluminum, steel, or any other suitable strong material that prevents the open end from flexing inward when the head is resting on strap 28.

In use frame 26 is passed over and under alternate straps forming the bed or cover of lounge 10. The length of the head rest extending beyond the end of the lounge 10 is adjusted by moving the frame 26 inward or outward beyond the end of the lounge. Note that adjustable head rest 24 may be attached without the use of any tools. Just slide it between alternate slots of the lounge, adjust for length and then lie down. There are no screws, bolts, clamps or fasteners whatsoever. Head rest 24 is completely portable. It is easily removed to carry to another lounge, quickly installed and ready to use in seconds. No fussing to tighten bolts or clamps is needed.

A particular advantage of the adjustable head rest of FIGS. 3*a* and 3*b* is that it is completely reversible and adaptable to other lounge constructions such as that illustrated in FIG. 4. In this lounge 10′ slats or straps 18′ are constructed in a crisscross or matrix construction with alternate straps being lengthwise and crosswise. The closed end 32 of the head rest illustrated in FIGS. 3*a* and 3*b* will not pass beneath the lengthwise straps 18″. To accommodate this type of construction strap or head support 28 can be slid down the arms of frame 26 to the closed end 32 allowing the adjustable head rest to be reversed for installation. The arms 31 of frame 26 can then be passed under and over alternate straps 18′ and between lengthwise straps 18″. The closed end 32 of the head rest is angled in the opposite direction from the open end 30 to present head support 28 at angle of 15 to 45 degrees to the plane of the head rest.

An alternate embodiment is shown in FIG. 3*c* in which the U-shaped head rest 80 can be collapsed to a small size for transportability. In this embodiment arms 82 and 84 are constructed of two or more telescoping tubes 86 and 88 that slide into tubes 90 and 92. To further collapse the U-shaped head rest, hinges 94 and 96 are provided at the ends of arms 82 and 84 near closed end 98. Head support or rest 100 can, as described previously be positioned at one end or the other depending on the type of lounge the head rest is to be used for or it can be removed for cleaning or replacement.

The U-shaped head rest 80 is collapsed for transporting by sliding head rest 100 to the closed end 98, collapsing telescoping arms 82 and 84 as illustrated by the arrow, then folding the arms inward toward the closed end 98 as indicated by the curved arrow. The telescoped folded arms are illustrated in the collapsed position in phantom. The head support 100 being a soft vinyl or cloth material will be compressed between the folded arms or could be completely removed before folding.

Another advantage of this embodiment is that it makes the U-shaped head rest even more versatile and adaptable. It is collapsible to a small size for transporting in a bag or suitcase and it is more adjustable than the head rest with the rigid frame. After installing the head rest and increasing or decreasing the amount slipped beneath the slats of a lounge it may be further adjusted by extending or retracting the telescoping arms.

Another alternate construction for the head rest for use with the cross weaved straps 18′ and 18″ of the chaise lounge of 10′ is shown in FIG. 6. In this embodiment bars 34 and 36 are joined by stiffening rods 38 and 40 with head support or strap 28′ being fixed to ends 42 and 44 slightly angled as described before. This leaves free ends 46 and 48. The head rest is thus easily installed in the lounges of either design by sliding free ends 46 and 48 under and over alternate crosswise straps 18′ (or 18) and between lengthwise straps 18″.

An alternate embodiment for the chaise lounge 10 having only the crosswise straps 18 is illustrated in FIGS. 7–10. In this embodiment an adjustable head rest 50 is in the form of a board having a planar surface 52 and a peripheral stiffening ridge 54, provided with a cutout 56 to accommodate the head. Closed head end 58 of the board is constructed with a flat surface at a slight angle as before and has a foam pad 60 fastened by an adhesive or any other suitable manner. The adjustable board head rest 50 easily fits beneath slats 18 as before and can be extended or retracted to provide an adjustable head rest.

Figure 12:
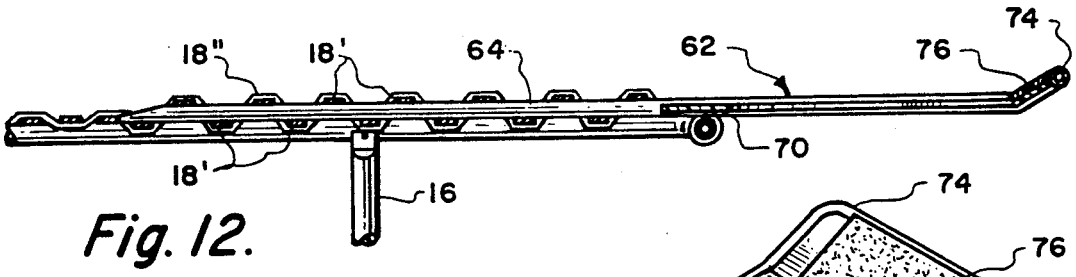
FIG. 12 is a sectional view taken at 12—12 of FIG. 11.
Figure 13:
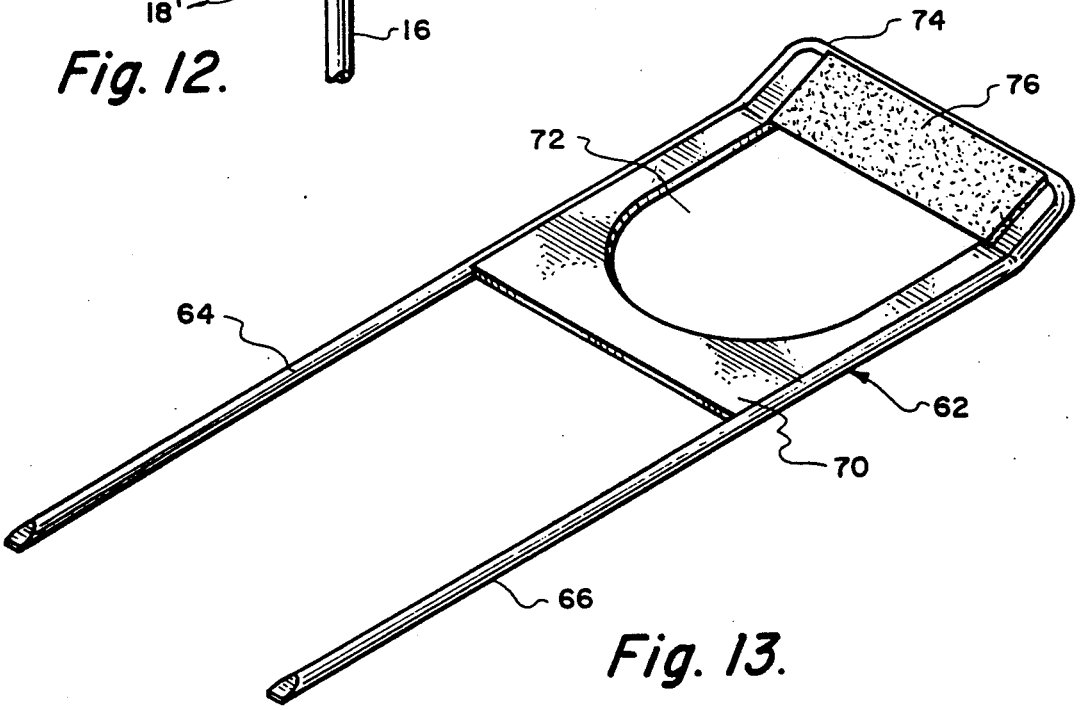
FIG. 13 is a perspective view illustrating use of the embodiment of FIG. 11.

Another alternate embodiment similar to that shown in FIGS. 7–10 is shown in FIGS. 11–13. The construction of this head rest 62 is similar to that shown in FIG. 10 except that arms 64 and 66 are provided to allow the head rest to easily slide beneath cross weave slats 18' (or 18) and 18'' as shown in FIG. 11. The length of arms 64 and 66 is designed to allow the head rest to be easily adjusted in or out beyond the end 68 of lounge 10'. Arms 64 and 66 form a frame for board 70 having a cutout 72 for the head. Closed head end 74 has a flat angled portion as before and has a foam pad 76 secured to head end 74 by an adhesive or any other suitable means.

Thus there has been disclosed an adjustable head rest for chaise lounges that allows a person to comfortably lie on their stomach with their face downward for resting or reading. In the preferred embodiment the head rest is not only adjustable but is extremely adaptable by being reversible to fit in either a cross slated lounge construction or a cross weave construction.

This invention is not to be limited by the embodiment shown in the drawing and described in the description which is given by way of example and not of limitation but only in accordance with the scope of the appendent claims.

I claim:

1. An adjustable head rest for chaise lounges comprising:

an elongate U-shaped frame having a pair of parallel bars joined at one end by a cross-bar so that said frame is closed at one end and open at the other, said U-shaped frame being constructed to fit between alternate cross-straps of said chaise lounge;

a head support slidably mounted on and spanning an end of said parallel bars so that said head support can be slidably moved from one end of said U-shaped frame to the other;

whereby said head rest can be adjustably mounted on a chaise lounge by inserting either end of said U-shaped frame between alternate cross-straps.

2. The adjustable head rest according to claim 1 in which the ends of said-shaped frame on which said head support are mounted are slightly bent at opposite angles.

3. The head rest according to claim 2 in which the end portion of said frame on which said head support may be mounted are tilted at an angle in the range of 15 to 45 degrees to the plane of the head rest.

4. The head rest according to claim 2 in which said head support is constructed of a soft material that has each end wrapped around said parallel bars and fastened.

5. The head rest according to claim 4 in which said soft material is selected from the group consisting of cloth, leather, or vinyl.

6. The head rest according to claim 1 in which the end portions of said frame on which said head support may be mounted are bent at an angle in the range of 15 to 45 degrees to the plane of the head rest.

* * * * *